United States Patent [19]

Bergner

[11] Patent Number: 4,814,003

[45] Date of Patent: Mar. 21, 1989

[54] APPARATUS AND METHOD FOR EXTRACTION AND RECOVERY OF PRECIOUS METAL USING COHERENT RADIATION

[76] Inventor: Richard M. Bergner, P.O. Box 1471, Wickenburg, Ariz. 85358

[21] Appl. No.: 149,411

[22] Filed: Jan. 29, 1988

[51] Int. Cl.[4] ..... C22B 4/00

[52] U.S. Cl. ..... 75/10.13; 75/63; 75/83

[58] Field of Search ..... 75/10.13, 63, 5, 83

[56] References Cited

U.S. PATENT DOCUMENTS 3,148,971 9/1964 MacDonald ..... 75/5

4,685,963 8/1987 Saville ..... 75/83

*Primary Examiner*—Peter D. Rosenberg

*Attorney, Agent, or Firm*—William W. Holloway

[57] ABSTRACT

Apparatus and method for extracting and recovering precious metals from source materials, such as ore materials, incorporating these components, includes conditioning the ore to have particle dimensions less than a predetermined size. The resulting particles are exposed to coherent radiation of sufficient intensity that, after focusing, the radiation can vaporize or melt precious metals incorporated in the particles or change the particles themselves. The processed ore particles are removed from the processing site. The processing site can have an inert gas environment, the inert gas carrying the precious metal vapor to a site in which condensation and filter apparatus removes the vaporized precious metal from the inert gas. When the precious metals are melted, the solidification of the melted precious metals typically occurs on the exterior of the particle originally incorporating the precious metals. The process is applicable, not only to ores, but also to waste or resulting process materials such as "fly ash", "sludge ash" or any other materials in which the recovery components are present in sufficient quantitites to make the process economically feasible.

16 Claims, 3 Drawing Sheets

APPARATUS AND METHOD FOR EXTRACTION AND RECOVERY OF PRECIOUS METAL USING COHERENT RADIATION

BACKGROUND OF THE INVENTION

1. Field of the Invention

This invention relates generally to the technology involving separation of material components and, more particularly, to the extraction and recovery of precious metals, or fines, from ores and other source materials.

2. Description of the Related Art

In the past, the extraction and recovery of the precious metals constituents from the raw ore matrix have typically been performed by heating or chemically treating the unprocessed ore and separating the precious metal constituents.

Recently, the increasing requirement for precious metals has resulted in a depletion of the high grade ores. As lower grade ores are used as a source of precious metals, the extraction or separation process has become increasingly difficult and expensive. In a majority of situations, tons of ore must be processed to extract and recover ounces of precious metals. Thus, the processing of ores of increasingly inferior quality has placed stringent demands on the processing techniques. These stringent demands have been imposed at a time of steadily mounting energy costs and in the face of increasing regulation with respect to the impact of the processing on the environment.

A need has therefore been felt for apparatus and for methods for processing low grade ores and other source materials (i.e., ores an materials with low concentrations of the recovery component) to extract precious metals therefrom in a manner which is economically competitive and environmentally feasible.

FEATURES OF THE INVENTION

It is an object of the present invention to provide improved processing of ores and other source materials.

It is a feature of the present invention to provide an improved technique for the extraction and recovery of precious metal from an ore matrix or from other source materials.

It is another feature of the present invention to extract and recover precious metals from an ore matrix or from other materials by applying a focussed laser beam to the unprocessed material.

It is still another feature of the present invention to extract and recover precious metals from an ore matrix or from other materials by using coherent radiation impinging on the materials to vaporize the precious metals.

It is a further feature of the present invention to vaporize precious metals embedded in an ore matrix or in other materials and to recover the precious metals by condensation of the vaporized precious metals.

It is a still further feature of the present invention to provide a technique for the recovery of selected incorporated components from materials that result from unrelated processing of source materials.

It is yet a more particular feature of the present invention that, immediately after vaporization, the recovery component particles condense in the form of dust, the condensation resulting from the lower ambient temperature in the vicinity of the processing site.

It is yet another particular feature of the present invention to provide a technique for the transport of the recovery material dust to separator and/or filter units for collection of the recovery material.

SUMMARY OF THE INVENTION

The aforementioned and other features are accomplished, according to the present invention, by preparing an ore matrix or other source materials in such a manner that the particle size of the source materials to be processed is less than a predetermined particle size. The prepared materials are distributed uniformly. The distributed prepared materials have a preselected thickness, and are exposed to focused coherent radiation, the preselected thickness permitting a substantial portion of the source material to be so exposed. The focused coherent radiation has sufficient intensity to provide a change for the recovery component(s) incorporated for the distributed material or in the distributed material itself. The processed (i.e., by coherent radiation exposure) material is removed from the processing region. The selected recovery component, when sufficient energy has been applied to vaporize the recovery component, can be carried by an inert gas to a filtration apparatus. When the recovery component, as a result of the intensity of the radiation, is liquified (i.e., melted) and resolidified, the recovery component can be separated from the processed material by cyclone separators or other suitable mechanical or chemical separation techniques. By controlling the intensity of the coherent radiation impinging on the distributed material at a plurality of sites (i.e., increasing the radiation to preestablished levels at the plurality of processing sites), a plurality recovery components can be selectively removed from the source material.

These and other features of the invention will be understood upon reading of the following description along with the drawings.

DESCRIPTION OF THE PREFERRED EMBODIMENT

1. Detailed Description of the Figures

Figure 1:
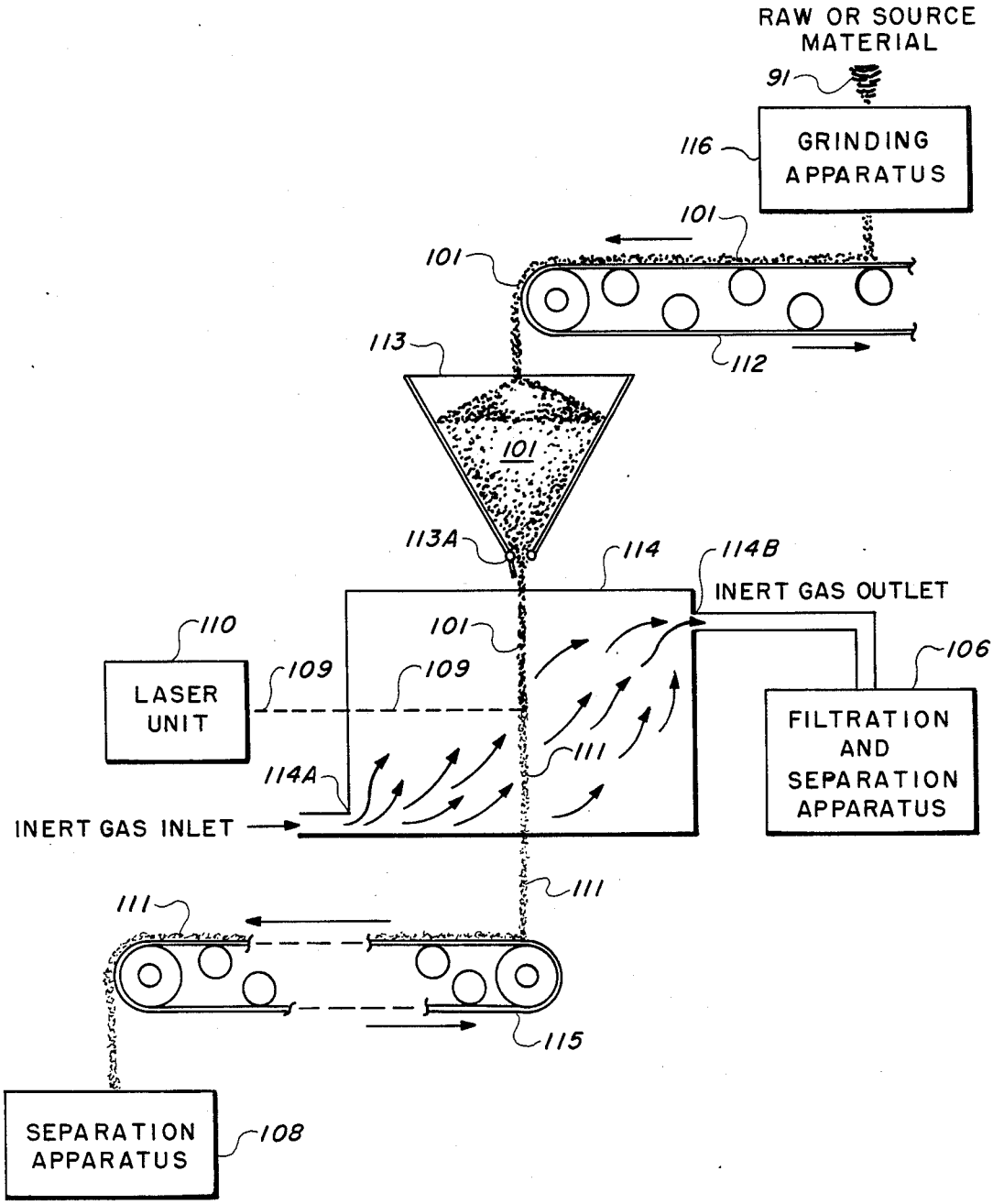
FIG. 1 is a first embodiment of the apparatus for extracting and recovering precious metals from an ore matrix.

Referring now to FIG. 1, a first embodiment of the apparatus for extracting and recovering components such as precious metals from an ore matrix or other source materials is shown. The source material 91 is introduced into grinding apparatus 116. Grinding apparatus 116 provides the first process step by providing a feed material 101 having particles less than a preselected maximum particle size. The feed material 101 is transferred from the grinding apparatus 116 to a hopper unit 113 by means of a conveyor belt assembly 112. The hopper unit 113 has an adjustable opening 113A through which the feed material 101 exits from the hopper unit 113 under the force of gravity and falls through the chamber unit 114. While falling through the processing chamber unit 114, a beam of coherent radiation 109 from laser unit 110 enters the processing chamber unit 114 through a window or aperture (not shown) and produces a change in the falling feed material 101 to produce a processed material 111. The falling processed material 111 exits from the chamber unit 114 by an aperture not shown and is deposited on conveyor belt assembly 115. The conveyor belt assembly 115 removes the processed material 111 from the vicinity of the processing chamber unit 114. For one mode of operation in which the recovery component of the feed material 101 is vaporized by the impinging laser beam 109, an inert gas is introduced into processing chamber unit 114 by orifice 114A and is removed from the processing chamber unit 114 through orifice 114B. The orifice 114B is coupled to filtration and separation apparatus 106. The vaporized recovery component is carried from the processing chamber unit 114 by the flow of inert gas or other suitable gas component and extracted in the filtration and separation apparatus 106. When the recovery component is not vaporized by the impinging laser beam 109, but rather is removed from the feed material 101 matrix and/or is concentrated in regions of the processed material 111, then the processed material 111 can be introduced into a separation apparatus 108 wherein the recovery component can be separated from the remainder of the processed material 111.

Figure 2:
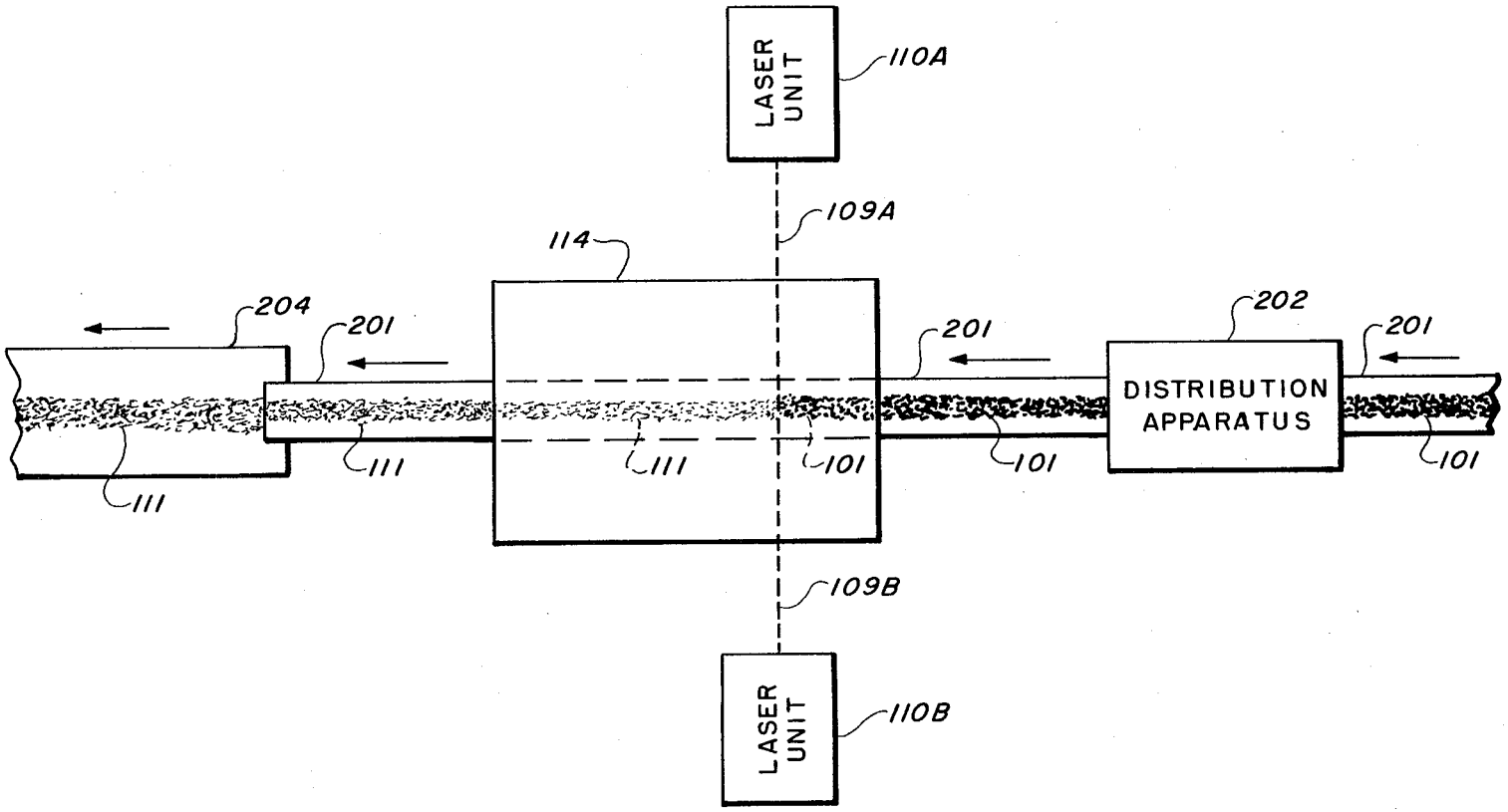
FIG. 2 is a second embodiment of the apparatus for extracting and recovering precious metals from an ore matrix.

Referring next to FIG. 2, a top view of a second implementation of the apparatus for extracting and recovering selected components from a feed material 101 is shown. The feed material 101, having been processed to insure that no particle exceeds a preselected size (i.e., as indicated by grinding apparatus 108 in FIG. 1) is deposited on conveyor belt assembly 201. The conveyor belt assembly 201 transports the feed material 101 through distribution apparatus 202. In distribution apparatus 202, the feed material 101 is spread out on the carrying surface of conveyor belt assembly to minimize the shadowing of the laser radiation on particles of the feed material 101 covered by other particles of the feed material 101. The conveyor belt assembly 201 transports the now distributed feed material 101 into the processing chamber unit 114. In processing chamber unit 114, coherent radiation 109A (and 109B) from laser unit 110A (and 110B) are applied to the feed material. The impinging radiation processes the feed material 101 to become processed material 111. The processed material 111 can be deposited from conveyer belt assembly 201 to conveyor belt assembly 204 for removal from the processing site (i.e., chamber unit 114). As in FIG. 1, processing chamber 114 can have an inert gas flowing therethrough to carry the selected recovery material from processing chamber 114 to filtration and separation apparatus (106). In a manner similar to that shown in FIG. 1, the processed material 111 can be transported to separation apparatus (108) wherein the recovery components can be separated from the processed material 111 (e.g., by chemical techniques, cyclone separators, etc., depending on the composition of the processed material 111).

Figure 3:
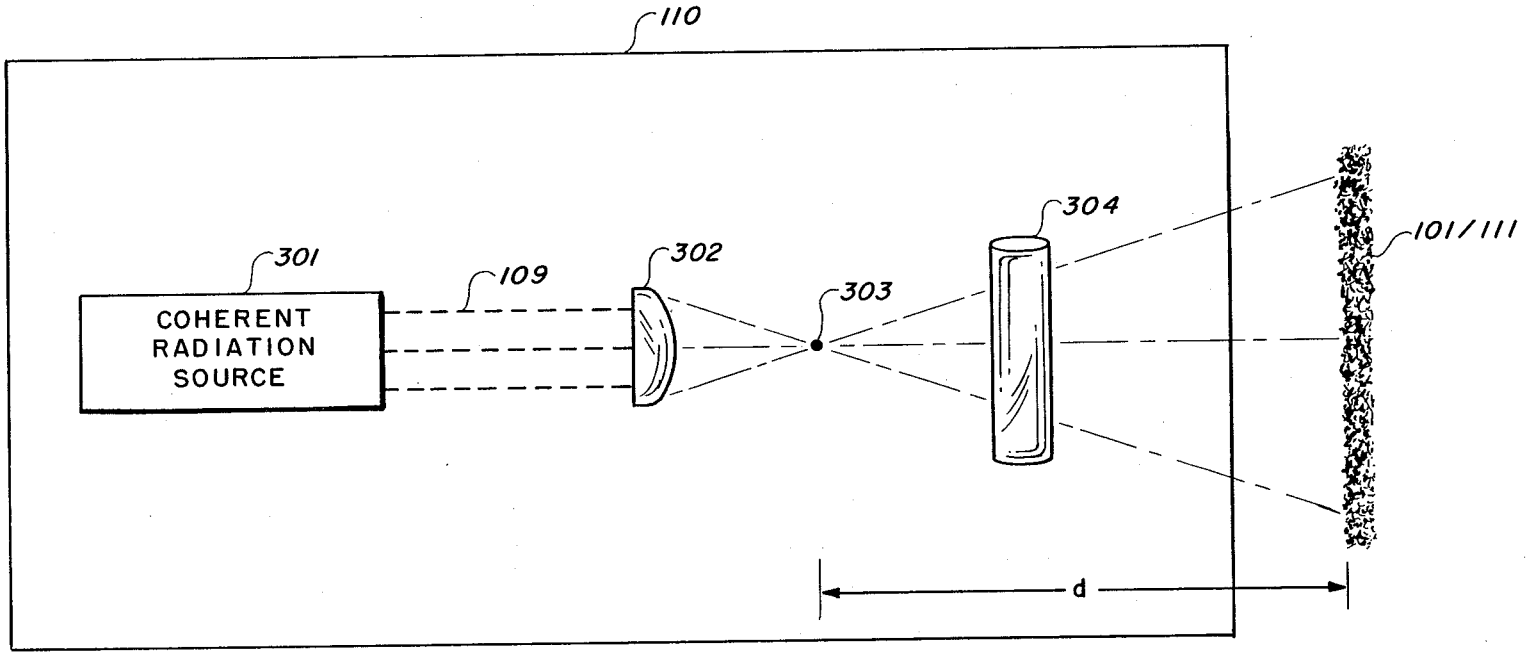
FIG. 3 illustrates one technique for applying coherent radiation to the distributed source material.

Referring next to FIG. 3, a top view of the laser unit 110, used in the preferred embodiment, is shown. The laser unit 101 includes a coherent radiation source 301 that provides a collimated beam 109 of coherent radiation. The laser radiation beam 109 is applied to lens 302 that focuses the coherent radiation 109 at focal point 303. Beyond the focal point 303, a cylindrical lens 304 focuses the coherent radiation 109 approximately on a line coinciding with plane defining the movement of the feed material 101. The movement of the feed material will generally be perpendicular to the plane of coherent radiation defined by cylindrical lens 304 and the focal point 303. In FIG. 3, the distance d designates the separation of the focal point of lens 304 and the line where the coherent radiation impinges on the feed material 101.

2. Operation of the Preferred Embodiment

The heat resulting from the interaction of the coherent laser radiation and the feed material can result, for selected feed materials and selected recovery materials, in a sufficient change in the source material to permit extraction of the recovery material. The coherent laser radiation is provided with sufficient intensity to vaporize or liquify the recovery materials incorporated in the feed material, or can change the structure of the feed material matrix incorporating the recovery material to permit application of previously ineffective extraction and separation processes. To be effective, the size of the feed material particles is reduced to a size which permits the incident coherent laser radiation to provide the requisite heating for a substantial majority of the particles of the feed material. When the feed material particles are too large, recovery materials incorporated therein can receive insufficient heat to result in vaporization and/or liquification of the recovery material or substantial change in matrix of the material incorporating the recovery material. Similarly, the particles comprising the feed material must be distributed in a manner to prevent substantial shadowing of the feed material particles by other feed material particles. In FIG. 1, this distribution is controlled by the controllable exit port 113A of the hopper unit 113, while in FIG. 2, the distribution apparatus 202 can adjust the feed material particle distribution on the conveyor belt assembly 201 surface. In addition, as indicated in FIG. 2, the effect of shadowing can be reduced by focusing a plurality of coherent laser radiation beams on the feed material particles from different directions.

The inert gas flowing through the processing unit provides a medium for controlling the motion of the materials removed from the feed material by vaporization and thereby can reduce the scattering of the incident coherent laser radiation by the products of vaporization. The inert gas can also be used to minimize chemical reactions, especially oxidation processes, that can be facilitated by the relatively high temperatures and the increased surface area of the vaporized recovery products.

The embodiment of the present invention shown in FIG. 1 has several advantages. For example, the inert gas that is used as an environment during the vaporization process can have a flow maintained therein that removes the vaporized metal from the vicinity of the vaporization site. This removal can reduce the effect of the vaporized precious metal on the intensity of the impinging coherent radiation and can reduce condensation on the ore matrix. The absence of the conveyor belt also removes a possible condensation site for the vaporized precious metals.

The effectiveness of the present technique for the extraction and recovery of precious metals from an ore matrix is further enhanced by the availability of high intensity, relatively efficient laser apparatus. The coherent nature of the radiation from the laser permits focusing of the energy to a well defined region, e.g., to a line generally coincident with the feed material in the preferred embodiment. Thus, although the total energy can be relatively small, in the vicinity of the focused radiation beam, the energy can be easily sufficient to vaporize or liquify recovery products or change the state of the feed material matrix incorporating the recovery material. As an example, the thermal shock of the coherent laser radiation can cause the feed material particles to disintegrate, making recovery products more susceptible to previously ineffective recovery techniques. The reaction of the feed material to the incident coherent laser radiation can result in exposed local (small) concentrations of the recovery material, again permitting previously ineffective recovery processes to be employed. In the vaporization of the recovery products, by adjusting the intensity of the incident coherent radiation in a plurality of processing chamber units, recovery materials can be selectively removed from the feed material.

By way of example, the following parameters have been used in the separation of a recovery material (precious metal) from a feed material (an ore). The size of the particles comprising the feed material are 20 mesh or smaller. The laser unit is a pulsed yttrium aluminum garnet (YAG) doped with neodymium. The laser unit is pulsed at 30 pulses per second delivering 1 Joule per $cm^2$. Each pulse delivers 400 watts or 100 watts per linear inch, the laser beam being focused over 4 linear inches. The spreading of the beam perpendicular to the 4 linear inches is estimated to be 20 thousandths of an inch. These dimensions result in overlap of the coherent radiation on the feed material as the feed material passes through the coherent radiation beam.

While the foregoing discussion has generally been described with particular reference to recovery of precious metals from an ore matrix, this process is also applicable to the by-products of large processing operations, such as "fly ash" and "sludge ash". These by-product materials are known to contain small, but significant quantities of component materials, such as precious metals, for which recovery has, in the past, not proven economically feasible. The incineration of waste materials is a notable example, as are many of the by-products resulting from the processing of semiconductors. The extraction and recovery technique of the present invention provides an economically feasible technique for the recovery of these materials.

The foregoing description is included to illustrate the operation of the preferred embodiment and is not meant to limit the scope of the invention. The scope of the invention is to be limited only by the following claims. From the foregoing description, many variations will be apparent to those skilled in the art that would yet be encompassed by the spirit and scope of the invention.

What is claimed is:

1. Apparatus for extracting and recovering at least one selected component from a feed material incorporating the selected component, said apparatus comprising:

sizing means for providing a feed material having particles smaller than a predetermined size;

spreading means for providing a selected distribution of said feed material particles moving through a predetermined region;

radiation means for irradiating said predetermined region with coherent radiation having an intensity greater than a preselected value, said coherent radiation causing at least one preselected property of said feed material to be altered; and recovery means for recovering said selected component from said feed material particles after irradiation by said coherent radiation, said recovery means using said altered preselected property for recovery of said preselected component.

2. The apparatus for extracting and recovering a selected component of claim 1 wherein said coherent radiation alters said preselected property in a one of said selected component and said feed material particles.

3. The apparatus for extracting and recovering a selected component of claim 2 wherein said coherent radiation causes said recovery component to vaporize, said recovery means including an inert gas atmosphere for transport of said vaporized recovery component.

4. The apparatus for extracting and recovering a selected component of claim 3 further comprising recovery means, said recovery means including apparatus for removing said selected component from said inert gas.

5. The apparatus for extracting and recovering a selected component of claim 3 wherein said radiation means includes apparatus for spreading said coherent radiation over a selected linear region through which said feed material is constrained to pass.

6. The apparatus for extracting and recovering a selected component of claim 5 wherein said radiation means includes:

a laser unit;

a lens for decollimating radiation from said laser unit; and a cylindrical lens for focusing said decollimating radiation on a linear region.

7. The apparatus for extracting and recovering a selected component of claim 2 wherein said coherent radiation causes said recovery component to be responsive to separation from said feed material by a preestablished technique as a result of said altered preselected property, said apparatus further comprising separation means for separating said recovery component from said feed material.

8. The apparatus for extracting and recovering a selected component of claim 5 wherein said spreading means includes a hopper unit for controlling a distribution of feed material particles released therefrom, said hopper unit positioned to permit said released feed material particles to fall through said selected linear region.

9. The apparatus for extracting and recovering a selected component of claim 5 wherein said spreading means includes;

a conveyor belt assembly transporting said feed material particles through said selected linear region; and;

a distribution means for controlling a distribution of said feed material particles on said conveyor belt assembly.

10. The apparatus for extracting and recovering a selected component of claim 5 wherein said radiation means includes means for providing a plurality of preselected linear regions, each of said linear regions processing a different selected component.

11. Apparatus for extraction of selected components from source materials incorporating said selected components, said apparatus comprising:

chamber means for permitting passage of said source material therethrough;

laser means for providing a focused coherent radiation generally along a line within said chamber means; and distribution means for directing a substantial portion of said source material passing through said chamber means through said line, wherein said focused coherent radiation has an intensity to alter at least one selected property of said source material, said altered selected property permitting separation of said selected component from said source material.

12. The apparatus for extraction of selected components of claim 11 wherein said coherent radiation has an intensity to vaporize said selected component.

13. The apparatus for extraction of selected components of claim 12 further comprising gas means for causing a flow of gas through said chamber means and for transporting said vaporized selected component from said chamber means to a predetermined location.

14. The apparatus for extraction of selected components of claim 11 wherein said coherent radiation has an intensity to melt a substantial portion of said selected component, said apparatus further including separation means for separating a substantial portion of a resolidified selected component from a substantial portion of said source material.

15. The apparatus for extracting and recovering a selected component of claim 1 wherein said preselected property is chosen from the group consisting of changing the phase of said selected component and changing a structure of said feed material particles.

16. The apparatus for extraction of selected components of claim 11 wherein said selected property is chosen from a group consisting of a phase of said selected component and a structure of said source material.

* * * * *